US007232162B2

(12) United States Patent
Pickar

(10) Patent No.: US 7,232,162 B2
(45) Date of Patent: Jun. 19, 2007

(54) COMPOSITE DOOR LOCK PLUNGER

(75) Inventor: Barbara J. Pickar, New Hampton, IA (US)

(73) Assignee: Trimark Corporation, New Hampton, IA (US)

( * ) Notice: Subject to any disclaimer, the term of this patent is extended or adjusted under 35 U.S.C. 154(b) by 106 days.

(21) Appl. No.: 10/885,450

(22) Filed: Jul. 6, 2004

(65) Prior Publication Data

US 2006/0006664 A1 Jan. 12, 2006

(51) Int. Cl.
*E05C 1/10* (2006.01)

(52) U.S. Cl. ..... 292/175; 292/DIG. 57

(58) Field of Classification Search ..... 292/175, 292/173, DIG. 57
See application file for complete search history.

(56) References Cited

U.S. PATENT DOCUMENTS 4,331,355 A * 5/1982 Okuno ..... 292/251.5
4,676,081 A * 6/1987 Craig ..... 70/169
4,818,000 A * 4/1989 Bobrowski ..... 292/147
4,927,197 A * 5/1990 Predelli ..... 292/245
5,934,115 A * 8/1999 Bernier et al. ..... 70/208
6,547,290 B1 4/2003 Zenner et al.
6,568,723 B2 * 5/2003 Murphy et al. ..... 292/241

OTHER PUBLICATIONS

TriMark Catalog No. 060-0450 "EZ Access Baggage Door Lock" (10/03-2).
TriMark Catalog No. 060-0400 "Flush Baggage Lock" (05/03-2).

* cited by examiner

*Primary Examiner*—Gary Estremsky
(74) *Attorney, Agent, or Firm*—McKee, Voorhees & Seasem P.L.C.

(57) ABSTRACT

An approved plunger assembly is provided for a door handle. The plunger assembly includes a metallic plunger and a plastic link, which are connected so as to slide together between extended and retracted positions. The plastic link minimizes friction between the plunger assembly and the housing of the door handle, and minimizes wear between the link and the pivot plate which moves the plunger assembly from the extended position to the retracted position. The metallic plunger provides increased wear-resistance from contact with the striker plate or frame which surrounds the door in which the door handle is mounted.

10 Claims, 4 Drawing Sheets

COMPOSITE DOOR LOCK PLUNGER

BACKGROUND OF THE INVENTION

Door handles, such as those used on vehicles, including ingress and egress doors as well as compartment doors, such as on an RV, typically include a housing with a paddle pivotally mounted on the housing, and a pivot plate pivotally mounted on the rear of the housing for actuation by the paddle. A plunger is mounted on the housing for movement between a normally extended position to hold the door closed and a retracted position to allow opening of the door. Actuation of the handle causes the pivot plate to slide the plunger from the extended position to the retracted position. The frame surrounding the door handle typically includes a striker plate or surface which is struck by a beveled edge on the plunger as the door moves from the opened position to the closed position, with the plunger extending into a recess or behind the striker plate to retain the door in the closed position.

Prior art plungers have a one-piece construction, and have been made of both metal and plastic. A metal plunger has increased friction, which increases the release efforts required to open the door. Also, a metal plunger has increased wear with the pivot plate, which is normally made of steel, so that the plunger has a reduced life expectancy. In comparison, a plastic plunger has a reduced coefficient of friction, as compared to a metal plunger, so as to minimize the release efforts required to open the door, but has poor wear caused by repeated engagement with the striker plate so as to reduce the life of the plastic plunger.

Accordingly, the primary objective of the present invention is the provision of an improved plunger assembly for a door handle which has reduced friction and increased life.

Another objective of the present invention is the provision of a composite plunger for a door handle which reduces release efforts and increases wear.

A further objective of the present invention is the provision of an improved door handle having a metal plunger with a plastic link.

Still another objective of the present invention is the provision of an improved plunger assembly with a plunger made from a wear-resistant material and a link made from a low-coefficient of friction material.

Another objective of the present invention is the provision of an improved plunger assembly for a door handle which is economical to manufacture and durable in use.

SUMMARY OF THE INVENTION

The composite plunger assembly of the present invention provides an improved door handle. The assembly includes a metal plunger and a plastic link. The plunger includes a recess to receive a finger on the link such that the plunger and link are connected for movement between an extended position and a retracted position. The link includes a recess defining a shoulder for engagement by a pivot plate on the door handle. Actuation of the door handle pivots the plate so as to slide the link and plunger assembly to a retracted position from the normally biased extended position. The plastic link provides for reduced friction between the link and the housing, thereby minimizing the release effort required by a user of the handle. The plastic link also provides increased wear resistance between the pivot plate and the link for longer life and reduced effort. The metallic plunger has a hardness which minimizes wear when engaging the striker plate in the frame surrounding the door in which the handle is mounted.

DETAILED DESCRIPTION OF THE PREFERRED EMBODIMENT

Figure 1:
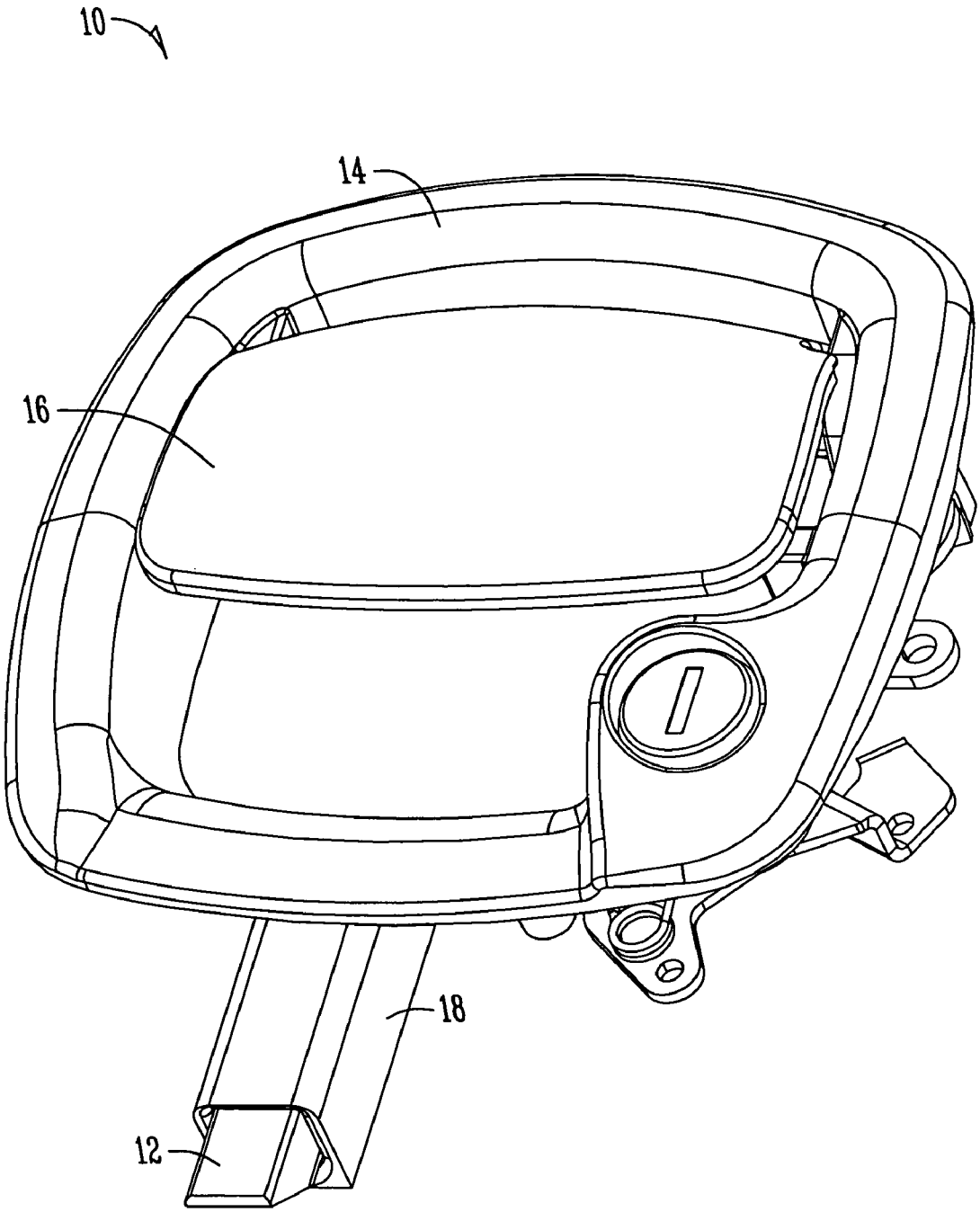
FIG. 1 is a perspective view of the door handle having the improved plunger assembly of the present invention.

FIG. 1 shows a door handle 10 having the improved plunger assembly 12 of the present invention. The handle 10 includes a housing 14, with a paddle 16 pivotally mounted in the housing for movement between the normal closed position shown in FIG. 1 and a raised open position. The plunger assembly 12 is slidably mounted within a plunger tunnel 18, which is preferably formed as a part of the housing 14. The plunger assembly 12 is moveable between the extended position shown in FIG. 1, and a retracted position.

A pivot plate 20 is pivotally mounted on the rear of the housing 14. The paddle 16 engages and drives a pivot arm 22 on an axle (not shown). The axle extends through a hole in the housing 14 so that the arm 22 engages a first arm 24 on the pivot plate 20.

Figure 2:
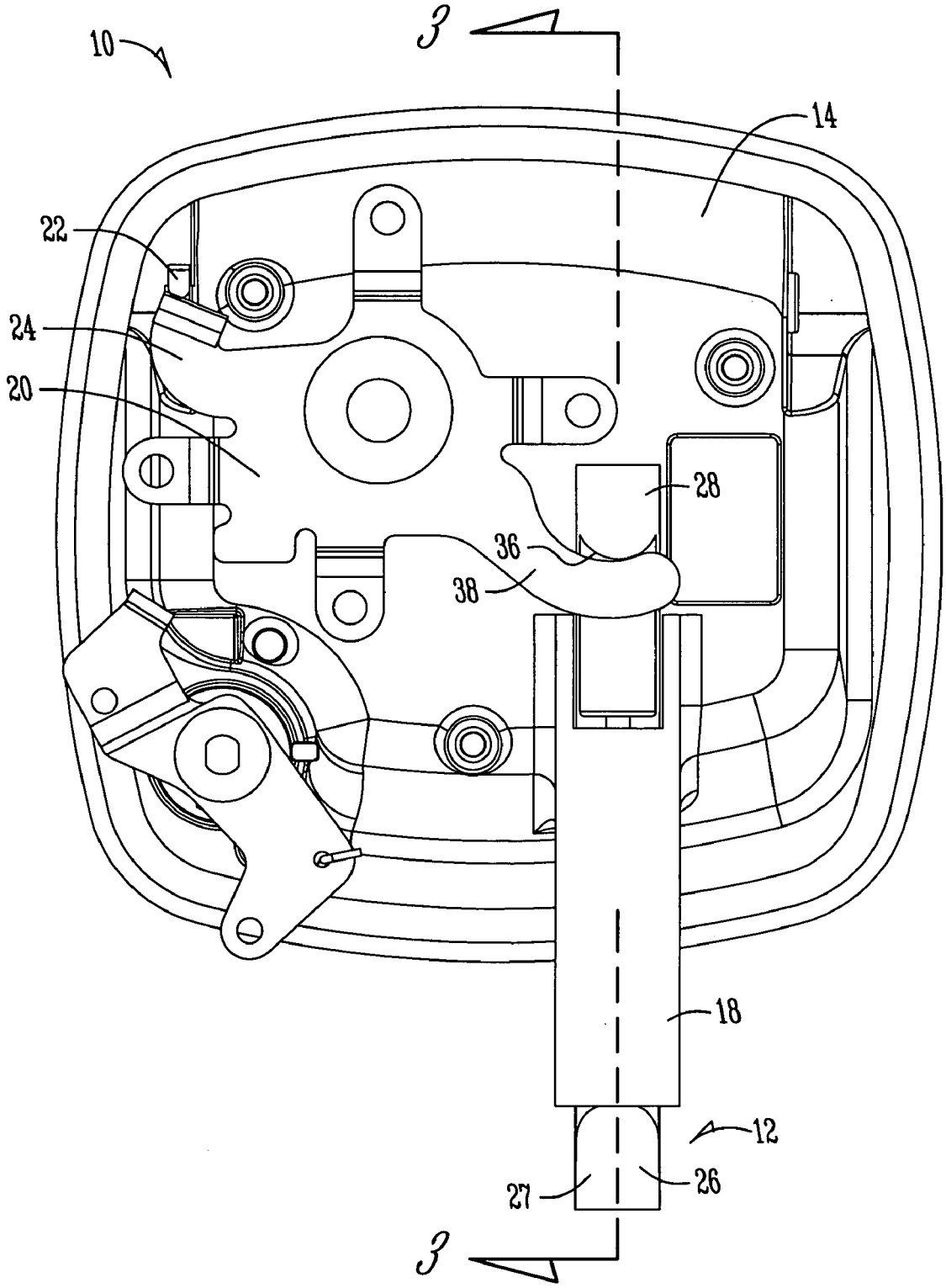
FIG. 2 is a rear elevation view of the door handle.

The present invention is directed towards the plunger assembly 12. As seen in FIGS. 3 and 5-8, the plunger assembly 12 includes a plunger 26 and a plunger link 28. The plunger 26 includes a beveled surface 27 adapted to engage a striker plate (not shown) or the frame surrounding the door (not shown) in which the handle 10 is mounted. The composite construction of the plunger 26 and the link 28 is a light press-fit assembly, with the plunger tunnel 18 maintaining the plunger 26 and the link 28 together. The plunger includes a recess 30 which receives a finger 32 on the link 28 so as to connect the plunger 26 and the link 28 together. The link 28 includes a recess 34 defining a shoulder 36 which is engaged by a second arm 38 on the pivot plate 20. Thus, upon actuation of the paddle 16, the pivot plate 20 rotates (in a counterclockwise position as seen in FIG. 2) such that the arm 38 pulls the plunger assembly 12 to a retracted position with the plunger 26 within the plunger tunnel 18, so that the door (not shown) in which the handle 10 is mounted can be opened. The paddle 16, pivot plate 20, and plunger assembly 12 are each spring biased, such that upon release of the paddle 16, the pivot plate 20 rotates in a clockwise direction (as shown in FIG. 2) and the plunger assembly 12 slides to the extended position shown in FIGS. 1 and 2.

Figure 3:
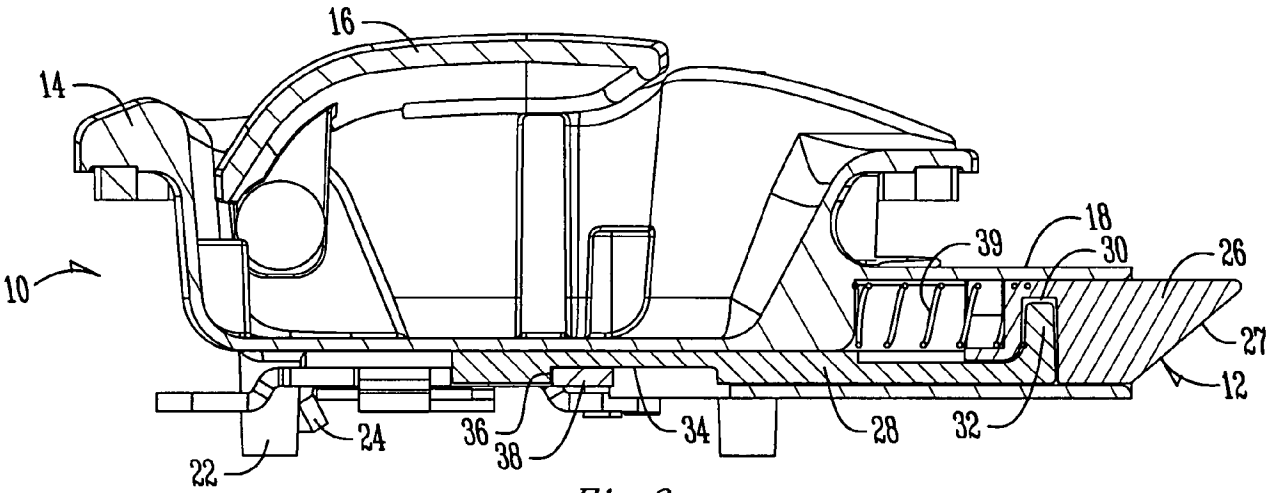
FIG. 3 is a sectional view along lines 3-3 of FIG. 2 and showing the composite plunger assembly of the present invention.

The plunger assembly 12 has a composite construction of a metallic plunger 26 and a plastic link 28. The plunger 26 is preferably made of zinc. The metallic plunger 26 has a hardness which provides wear-resistance to the repeated engagement with a striker plate or frame surrounding the door. The plastic link 28 provides for reduced friction, which reduces the release effort required by a person actuating the paddle 16. Also, the plastic material of the link 28 minimizes wear from engagement with the second arm 38 of the pivot plate 20. Therefore, the overall life of the plunger assembly 12 is extended. The plunger assembly 12 is biased to the extended position by a spring 39 mounted in the rear end of the plunger tunnel 18, and as seen in FIG. 3.

Figure 4:
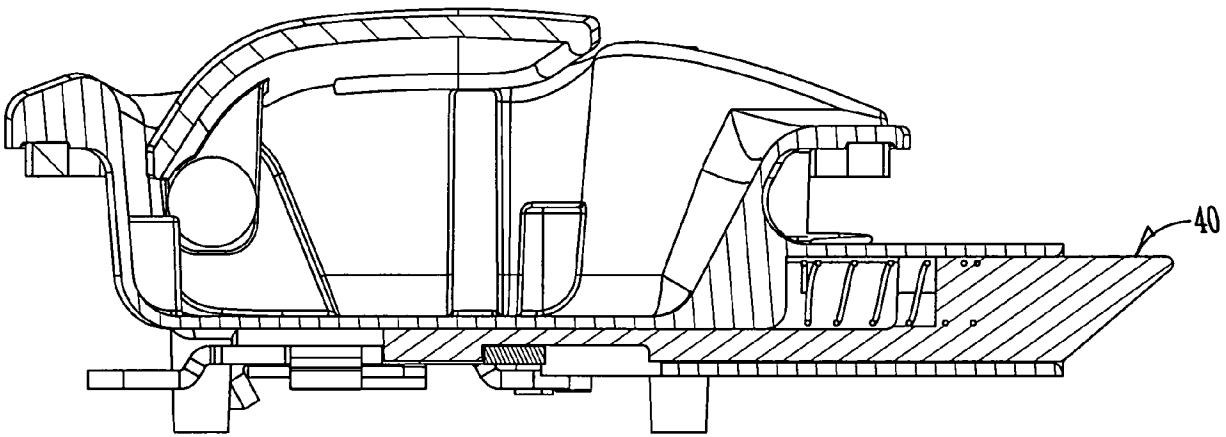
Fig. 4 (PRIOR ART)
FIG. 4 is a view similar to FIG. 3 showing a prior art plunger for a door handle.
Figure 5:
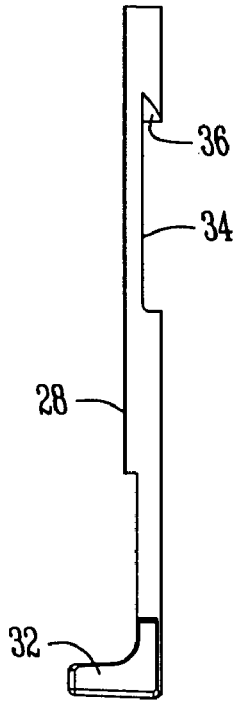
FIG. 5 is a side elevation view of the plunger link.
Figure 6:
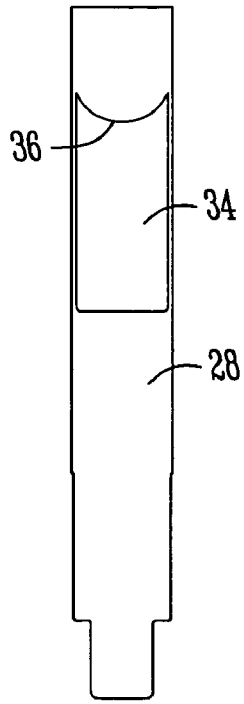
FIG. 6 is a top plan view of the plunger link.
Figure 7:
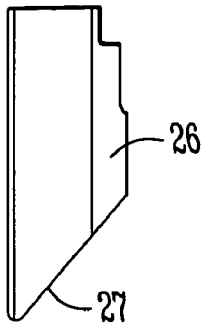
FIG. 7 is a side elevation view of the plunger.
Figure 8:
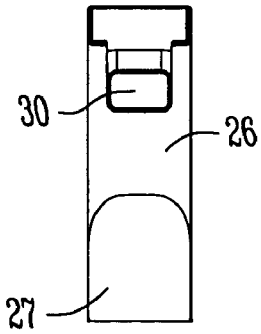
FIG. 8 is a top plan view of the plunger.

FIG. 4 shows a prior art one-piece plunger 40, which have been known to be made from either metal or plastic. The prior art metallic plunger 40 has increased friction, which increases the release effort required by a user. Also, the metallic plunger 40 has increased wear at the engagement with the pivot plate arm 38, which reduces the life of the plunger 40. For plastic plungers 40, there is excessive wear between the plunger and the strike plate, which shortens the plunger life.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A plunger assembly for a door handle, comprising:

a plunger made from wear-resistant material having a first coefficient of friction;

a plunger tunnel for housing the plunger, the tunnel supporting movement of the plunger; and a link made from material having a second coefficient of friction, the second coefficient of friction being lower than the first coefficient of friction;

the plunger and link being connected so as to move together between extended and retracted positions relative to the tunnel.

2. The plunger assembly of claim 1 wherein the wear-resistance of the plunger is greater than the wear-resistance of the link.

3. The plunger assembly of claim 1 wherein the hardness of the plunger is greater than the hardness of the link.

4. The plunger assembly of claim 1 wherein the plunger is constructed of zinc.

5. The improved plunger assembly of claim 1 wherein the plunger has a solid metal body with D-shape cross-section.

6. The plunger assembly of claim 1 wherein the plunger has a recess extending inward from a perimeter edge and the link has a finger extending angularly for receipt in the recess so as to connect the plunger and link together.

7. The plunger assembly of claim 1 wherein the plunger has a recess extending transverse to a longitudinal axis of the plunger assembly and the link has a finger extending transverse to a longitudinal axis of the plunger assembly received in the recess so as to connect the plunger and link together.

8. The improved plunger assembly of claim 1 wherein the link has a shoulder for engagement by an actuation plate of the door handle.

9. The improved plunger assembly of claim 8 wherein the shoulder is formed by a recess in the link.

10. The plunger assembly of claim 1 wherein the plunger and link move longitudinally within the plunger tunnel.

* * * * *